US010767325B2

(12) United States Patent
Humphries et al.

(10) Patent No.: US 10,767,325 B2
(45) Date of Patent: Sep. 8, 2020

(54) IMPACT ABSORBING TRAFFIC NOISE BARRIER SYSTEM

(71) Applicant: Superior Transparent Noise Barriers, Ardmore, PA (US)

(72) Inventors: Eric Christian Humphries, Moodus, CT (US); Robert George Rex, Sr., Ardmore, PA (US)

(73) Assignee: Superior Transparent Noise Barriers LLC, Ardmore, PA (US)

( * ) Notice: Subject to any disclaimer, the term of this patent is extended or adjusted under 35 U.S.C. 154(b) by 0 days.

(21) Appl. No.: 16/229,022

(22) Filed: Dec. 21, 2018

(65) Prior Publication Data

US 2019/0211518 A1 Jul. 11, 2019

Related U.S. Application Data

(60) Provisional application No. 62/613,821, filed on Jan. 5, 2018.

(51) Int. Cl.

| | |
|---|---|
| ***E01F 15/02*** | (2006.01) |
| ***E01F 15/08*** | (2006.01) |
| ***E01F 8/00*** | (2006.01) |

(52) U.S. Cl.

CPC ..... *E01F 15/088* (2013.01); *E01F 8/0017* (2013.01); *E01F 8/0023* (2013.01); *E01F 15/083* (2013.01); *E01F 15/086* (2013.01)

(58) Field of Classification Search

CPC ..... E01F 15/08; E01F 15/083; E01F 15/086; E01F 15/088; E01F 7/04

USPC ..... 256/13.1; 404/6, 9, 10

See application file for complete search history.

(56) References Cited

U.S. PATENT DOCUMENTS

| | | | | |
|---|---|---|---|---|
| 1,895,670 A * | 1/1933 | Langenheim | ..... | E01F 15/025 256/48 |
| 2,193,747 A | 3/1940 | Thompson | | |
| 3,353,795 A * | 11/1967 | Muller | ..... | E01F 9/635 256/13.1 |

(Continued)

FOREIGN PATENT DOCUMENTS

| | | | | |
|---|---|---|---|---|
| CH | 334548 A * | 12/1958 | ..... | E01F 15/083 |
| FR | 2457928 A1 | 12/1980 | | |

(Continued)

*Primary Examiner* — Thomas B Will
*Assistant Examiner* — Katherine J Chu
(74) *Attorney, Agent, or Firm* — GrayRobinson, P.A.; Michael J. Colitz, III

(57) ABSTRACT

Disclosed is an impact resistant traffic noise barrier system. The system includes a traffic barrier that is designed to be placed adjacent a roadway and next to a flow of traffic. The design and weight of the traffic barrier permit it to withstand a variety of vehicle impacts. As part of the system, a sound wall is installed along the top of the traffic barrier. The sound wall includes a series of beams that are secured to the traffic barrier via anchor plates. Acoustic panels are secured between adjacent beams. An anchor cable extends from an anchor post, to a first post, and along a number of intermediate posts. The anchor cable is thus suspended above the traffic barrier with the anchor cable being connected to the beams. As such, the anchor cable suspends the beams in the event they become separated from the traffic barrier.

10 Claims, 4 Drawing Sheets

(56) References Cited

U.S. PATENT DOCUMENTS 3,388,892 A * 6/1968 Case ..... E01D 19/103 256/13.1
4,111,401 A 9/1978 Pickett
4,143,495 A * 3/1979 Hintz ..... E01F 8/007 181/290
4,183,505 A * 1/1980 Maestri ..... E01F 15/0469 114/220
4,214,411 A * 7/1980 Pickett ..... E01F 8/0017 181/210
4,228,867 A 10/1980 Wirt
4,529,174 A 7/1985 Pickett
4,643,271 A 2/1987 Coburn
4,685,656 A 8/1987 Lee et al.
4,838,524 A 6/1989 McKeown et al.
4,930,752 A * 6/1990 Wolper, Jr. ..... E01D 19/103 256/13.1
5,015,119 A * 5/1991 Schmanski ..... E01F 7/06 256/13.1
5,040,352 A 8/1991 Oberlander et al.
5,052,850 A 10/1991 Bishop
5,074,705 A 12/1991 Schmitt
5,181,695 A * 1/1993 Arthur ..... E01F 7/06 256/13.1
5,186,438 A * 2/1993 Cross ..... E01F 7/04 256/12.5
5,207,302 A 5/1993 Popp et al.
5,208,585 A 5/1993 Sprague
5,406,039 A * 4/1995 Rerup ..... E01F 8/0011 181/210
5,443,324 A 8/1995 Sullivan
5,524,875 A 6/1996 Thommen, Jr.
5,588,786 A 12/1996 House et al.
5,619,829 A * 4/1997 Tan ..... E01F 7/06 404/9
5,678,950 A 10/1997 Junker
5,942,736 A 8/1999 Cortonesi
5,961,099 A * 10/1999 Thommen, Jr. ..... E01F 7/04 256/12.5
5,984,044 A 11/1999 Christensen
6,006,858 A 12/1999 Shima et al.
6,016,887 A 1/2000 Underhill et al.
6,149,338 A * 11/2000 Anderson ..... E01F 7/06 256/1
6,190,085 B1 2/2001 Johansson
6,305,492 B1 10/2001 Oleiko et al.
6,328,284 B2 12/2001 Wilding
6,412,230 B1 7/2002 Zambelli et al.
6,533,250 B2 3/2003 Arthur
6,551,011 B1 4/2003 Valentine
6,644,888 B2 * 11/2003 Ochoa ..... E01F 15/0438 404/6
6,669,402 B1 12/2003 Davis et al.
6,718,672 B1 4/2004 Wieringa
6,827,179 B2 * 12/2004 Drake ..... E01F 8/0011 181/290
6,926,461 B1 8/2005 Faller et al.
7,104,720 B2 * 9/2006 Humphries ..... E01F 8/0017 256/13.1
7,220,077 B2 * 5/2007 Humphries ..... E01F 8/0017 404/6
7,364,137 B2 * 4/2008 Neusch ..... E01F 15/06 256/13.1
7,530,548 B2 * 5/2009 Ochoa ..... E01F 15/0423 256/13.1
7,562,453 B1 * 7/2009 Benner ..... A01G 13/10 256/1
8,001,880 B2 * 8/2011 White ..... E01F 13/12 404/6
8,992,116 B2 * 3/2015 Sloan ..... E01F 13/12 256/13.1
D775,512 S * 1/2017 White ..... D8/354
10,221,529 B1 * 3/2019 Sanders ..... H02G 3/386
10,335,707 B2 * 7/2019 Nunes ..... A63K 1/00
2001/0014254 A1 8/2001 Albritton
2002/0127056 A1 9/2002 Muller et al.
2003/0057410 A1 3/2003 Denman et al.
2003/0077120 A1 4/2003 Jonsson et al.
2006/0093430 A1 * 5/2006 Bergendahl ..... E01F 15/025 404/6
2006/0145131 A1 * 7/2006 Purvis ..... E04G 21/3223 256/13.1
2013/0189030 A1 * 7/2013 Miracle ..... E01F 13/048 404/6
2014/0110652 A1 * 4/2014 Leonhardt ..... E01F 15/0461 256/13.1

FOREIGN PATENT DOCUMENTS

NL 1024629 C1 11/2004
WO WO-2019058154 A1 * 3/2019 ..... E01F 13/022

* cited by examiner

IMPACT ABSORBING TRAFFIC NOISE BARRIER SYSTEM

CROSS REFERENCE TO RELATED APPLICATIONS

This application is a continuation of, and claims priority to, Provisional Patent Application Ser. No. 62/613,821 filed on Jan. 5, 2018 and entitled "Impact Absorbing Traffic Noise Barrier System." The contents of this application are expressly incorporated herein for all purposes.

BACKGROUND OF THE INVENTION

Field of the Invention

This invention relates to a traffic noise barrier system. More particularly, the present disclosure relates to a traffic noise barrier that is designed to absorb impacts from vehicles.

Description of the Background Art

Noise barriers are commonly used along roadways. Noise barriers, sometimes called sound walls, are installed along roadways, such as interstate highways, county roads, streets and other thoroughfares. The noise barriers are used to acoustically isolate adjacent areas from sounds associated with automobiles, trucks, motorcycles, and other vehicular traffic. The area protected by the barrier may be a subdivision, park, office complex, or any other area that desires to be relatively free of noise pollution. Noise barriers are increasingly common as traffic volumes and population densities increase.

Often times there is short distance between the roadway and the area to be protected. This can require installing the noise barrier close to the edge of the roadway. In some instances, the noise barrier must be installed less than 40 feet from the flow of traffic. In such situations, it is known to install a sound wall along the top of a crashworthy traffic barrier. Suitable crashworthy traffic barriers include concrete partitions or dividers. Other types of crashworthy traffic barriers are known in the art. Crashworthy barriers are designed to deflect vehicle impacts and re-direct the vehicle back into the flow of traffic. Crashworthy barriers are also designed to allow a vehicle to ride up the side of the barrier before re-directing the vehicle.

Placing the sound wall along the top of the traffic barrier can be problematic. In particular, the sound wall can adversely affect the intended operation of the crashworthy traffic barrier. A vehicle impacting the crashworthy barrier can become caught up in the sound wall. This may preclude the vehicle from re-entering traffic. Also, if the sound wall becomes detached from the crashworthy barrier, the vehicle, its occupants, or nearby pedestrians can become injured. For this reason, various efforts have been made to reinforce the connection between the sound wall and crashworthy barrier in the hope of preventing such detachment. However, these reinforced barriers tend to be heavy, difficult to erect, and expensive.

An example of such a system is disclosed in U.S. Pat. No. 7,220,077 to Humphries. Humphries '077 discloses a crashworthy traffic noise barrier system that includes a longitudinal barrier extending parallel to the path of traffic. The barrier includes a plurality of upstanding posts attached to the traffic noise barrier wall. Transparent panels are included that are reinforced with plastic bands or threads. The system further includes a series of beams that extend generally parallel to the top surface of the barrier.

Still yet another example is U.S. Pat. No. 7,104,720 to Humphries. Humphries 720 likewise discloses a traffic noise barrier system that includes a longitudinal barrier and a noise wall. However, the noise wall is positioned at a distance of 18 or more inches from a front surface of a longitudinal barrier. The distance between the noise wall and barrier being provided to prevent a vehicle from getting snagged or from vehicle intrusion.

Although the inventors of the background art achieve their own unique objectives, all suffer from drawbacks. The background art all involve heavy, difficult to erect, or expensive designs. Other designs of the background art involve multi-part, complex designs, all in an effort to prevent a noise wall from interfering with the normal operation of a crashworthy barrier. What is needed, therefore, is a simple, lightweight, and easily installed sound wall that does not detract from the intended operation of a crashworthy barrier.

Therefore, it is an object of this disclosure to provide an improvement which overcomes the aforementioned inadequacies of the prior art devices and provides an impact resistant traffic noise barrier system.

It is therefore an objective of the present system to position a sound wall above a traffic barrier in a manner that does not adversely affect the operation of the barrier.

It is a further objective of the present disclosure to create a traffic noise barrier system that is lightweight, inexpensive, and easy to install.

It is still yet another objective of the present disclosure to create a noise barrier system with a series of upstanding beams that are designed to give way in the event of a vehicle impact.

It is another objective of this system to create a noise barrier system with a series of acoustic panels that are supported by way of an anchor cable.

Still yet, a further objective of the present invention is to provide a series of acoustic panels that will stay supported by way of an anchor cable even after a vehicle impact.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an impact resistant traffic noise barrier system. The system includes a crashworthy traffic barrier that is designed to be placed adjacent a roadway and next to a flow of traffic. The design and weight of the traffic barrier permits it to withstand a variety of vehicle impacts. As part of the system, a sound wall is installed along the top of the traffic barrier. The sound wall includes a series of beams that are secured to the traffic barrier via anchor plates. Acoustic panels are secured between adjacent beams. An anchor cable extends from an anchor post, to a first post, and along a number of intermediate posts. In a preferred embodiment, the anchor cable is routed through holes in the acoustic panels. The beams include a frangible section that is designed to break upon an impact with a vehicle. When such an impact occurs, the acoustic panels are supported by the anchor cable and remain in place.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

Figure 1:
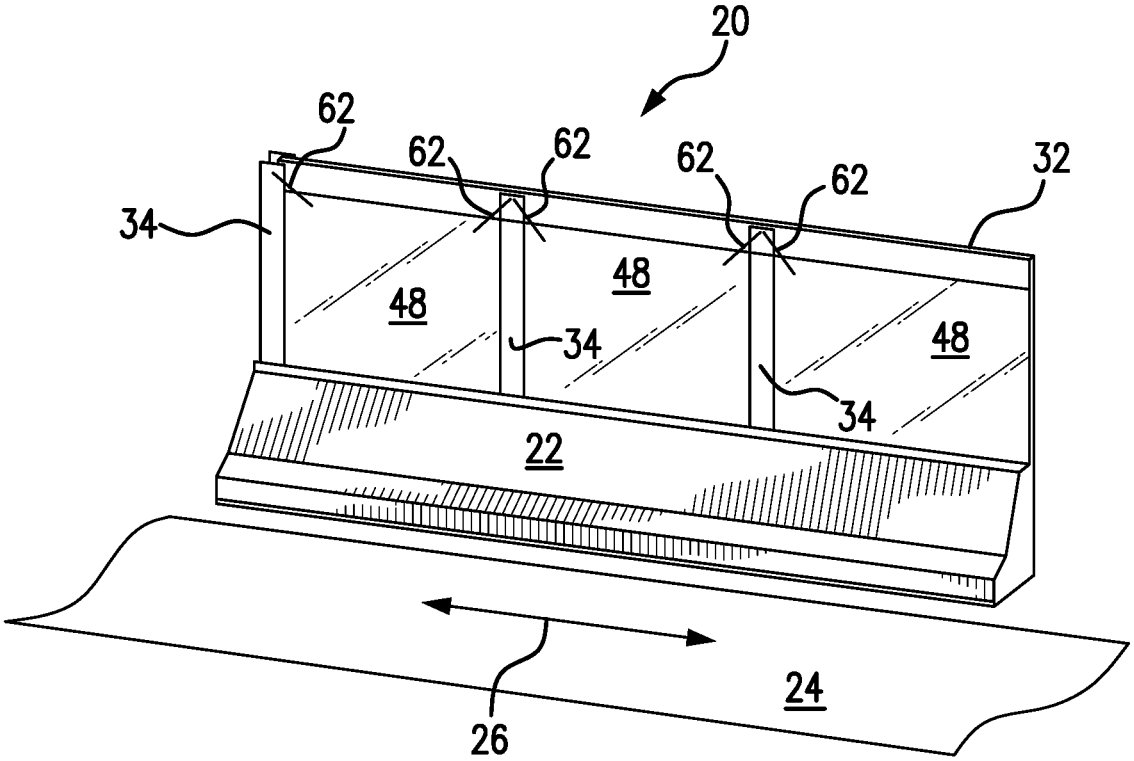
FIG. 1 is a perspective view of the front side of the impact resistant traffic noise barrier of the present disclosure.
Figure 2:
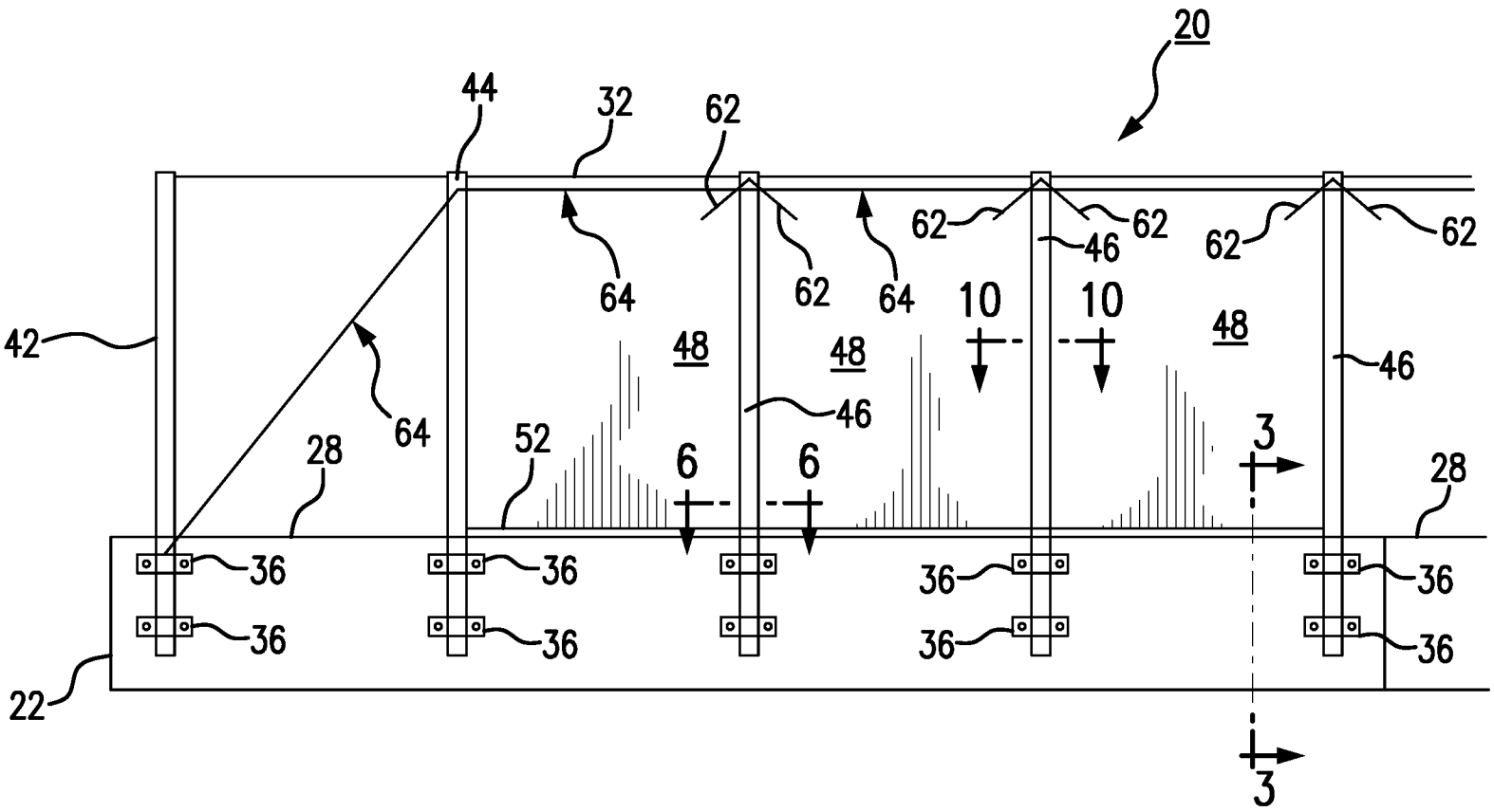
FIG. 2 is an elevational view of the rear side of the impact resistant traffic noise barrier of the present disclosure.
Figure 3:
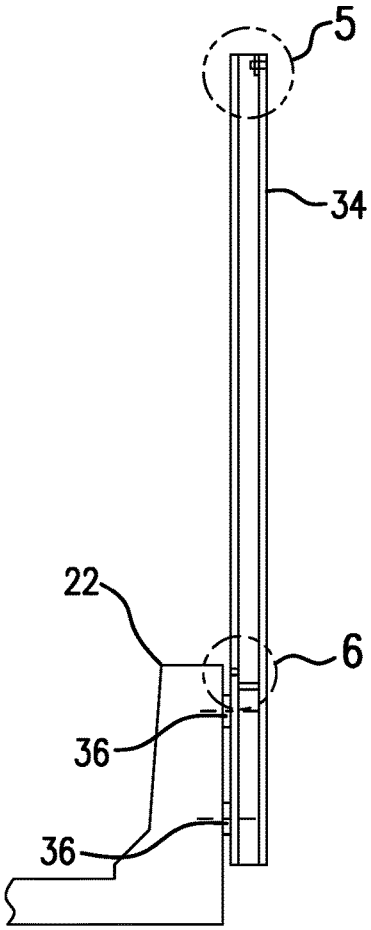
FIG. 3 is a sectional view taken along line 3-3 of FIG. 2.
Figure 4:
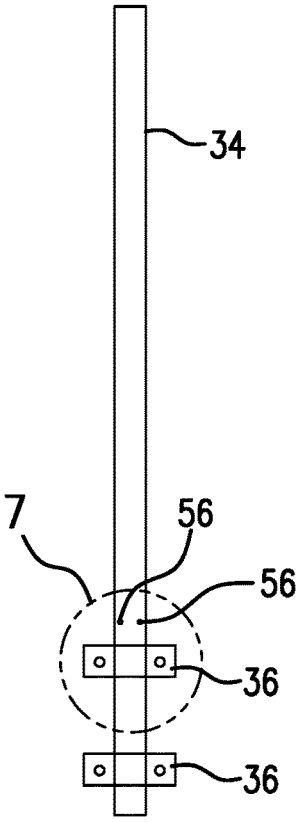
FIG. 4 is a front elevational view of FIG. 3.
Figure 5:
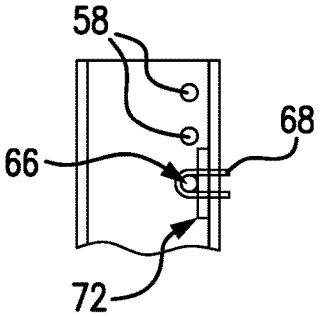
FIG. 5 is a detail view taken from FIG. 3.

| PARTS LIST |
|---|
| 20 Impact Resistant Noise Barrier System |
| 22 Crashworthy Traffic Barrier |
| 24 Roadway |
| 26 Flow of Traffic |
| 28 Continuous Upper Surface of Barriers |
| 32 Sound Wall |
| 34 Posts |
| 36 Anchorage Plates |
| 38 Anchor Bolts |
| 42 Anchor Post |
| 44 First Post |
| 46 Intermediate Posts |
| 48 Acoustical Panels |
| 52 L-Shaped Horizontal Bracket |
| 54 L-Shaped Vertical Bracket |
| 56 Protection Holes |
| 58 Restrainer Cable Holes |
| 62 Restrainer Cables |
| 64 Anchor Cable |
| 66 Guide Hole |
| 68 U-Shaped Clevis |
| 72 Shim Plate |

DETAILED DESCRIPTION OF THE PREFERRED EMBODIMENT

The present disclosure relates to a traffic noise barrier system that is impact resistant. The system includes a crashworthy traffic barrier that is designed to be placed adjacent a roadway and next to a flow of traffic. As part of the system, a sound wall is installed along the top of the traffic barrier. The sound wall includes a series of posts that are secured to the traffic barrier via anchor plates. Acoustic panels are secured between adjacent beams. An anchor cable extends from an anchor post, to a first post, and along a number of intermediate posts. In a preferred embodiment, the anchor cable is routed through holes in each of the posts. Each beam includes a frangible section that is designed to break upon an impact with a vehicle. When such an impact occurs, the beams and acoustic panels remain supported by the anchor cable. The various details of the present invention, and the manner in which they interrelate, are described in greater detail hereinafter.

As described, the system 20 of the present invention includes a longitudinally directed traffic barrier 22. As noted, this is a crashworthy traffic barrier 22 may be a concrete partition. Each barrier 22 includes an enlarged base and a sloped forward face. The barriers 22 are designed to absorb vehicle impacts, prevent the impacting vehicle from leaving the roadway 24, and ultimately re-direct the vehicle back into the flow of traffic 26. The longitudinal barriers 22 can be installed immediately adjacent to the flow of traffic 26. The barriers 22 are intended to be positioned in an end-to-end relationship with numerous barriers 22 extending along the traffic flow 26. The segmented nature of the barriers 22 allow the overall direction and shape of the traffic barriers 22 to be altered along the course of a roadway 24. With the traffic barriers 22 placed in an end-to-end relationship, a continuous upper surface 28 is formed along adjoining traffic barriers. The present disclosure is not limited to any particular traffic barrier design or construction.

The next component of this system is the sound wall 32 that is mounted to the continuous upper surface 28 of the barriers 22. Sound wall 32 consists of a series of upwardly extending posts 34, acoustic panels 48, restrainer cables 62, and an anchor cable 64. In the preferred embodiment, the series of upwardly extended posts 34 (or beams) are each secured to a back face of traffic barrier 22. In accordance with the invention, posts 34 are preferably I-beams that can be anywhere between 8-15 feet in length. The lower extent of each post 34 is anchored to the backside of an associated traffic barrier 22 by way of a pair of anchorage plates 36. Each anchorage plate 36, in turn, is bolted to the rearward face of the traffic barrier 22 by way of a pair of anchor bolts 38. As an alternative to the anchorage plates 36, posts 34 can be cast into the associated concrete traffic barrier 22 or they can be epoxied in place.

Thus, a set of four anchor bolts 38 and two anchorage plates 36 are used to secure the bottom portion of each I-beam post 34 to the back face of an associated crashworthy traffic barrier 22. The posts 22 are preferably spaced at even intervals along the length of the adjacent traffic barriers 22. In one representative installation, the adjacent posts 34 are separated by 8 feet. The first post of the series is designated as the anchor post 42, the second post is designated as the first post 44, and the remaining posts are designated as intermediate posts 46.

Figure 6:
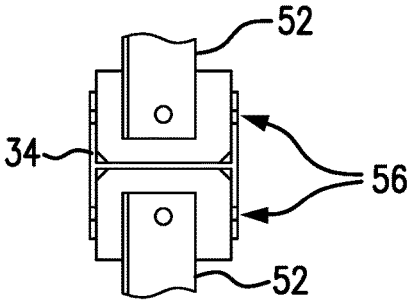
FIG. 6 is a plan view taken along line 6-6 of FIG. 2.
Figure 7:
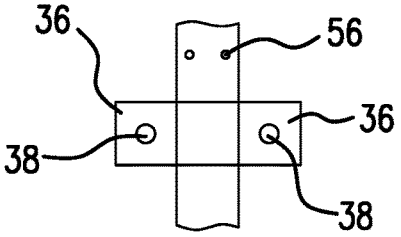
FIG. 7 is a detailed view taken from FIG. 4.
Figure 8:
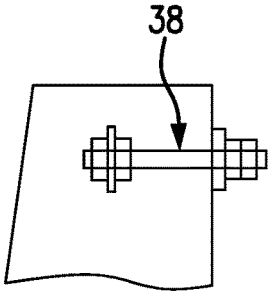
FIG. 8 is a detailed view of an anchor bolt and anchor plate of the present disclosure.
Figure 9:
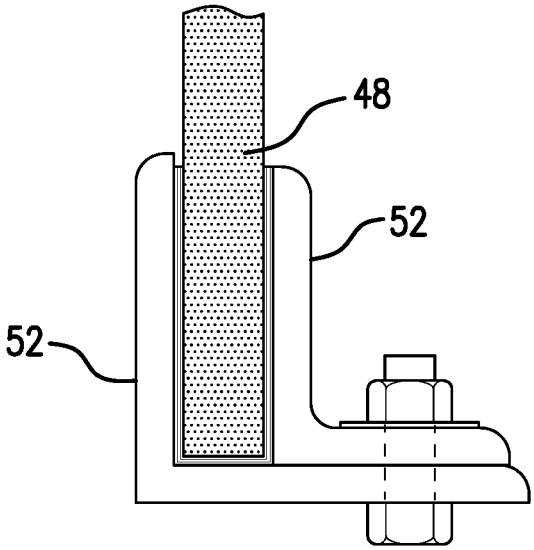
FIG. 9 is a detailed view of the lower bracket of the present disclosure.
Figure 10:
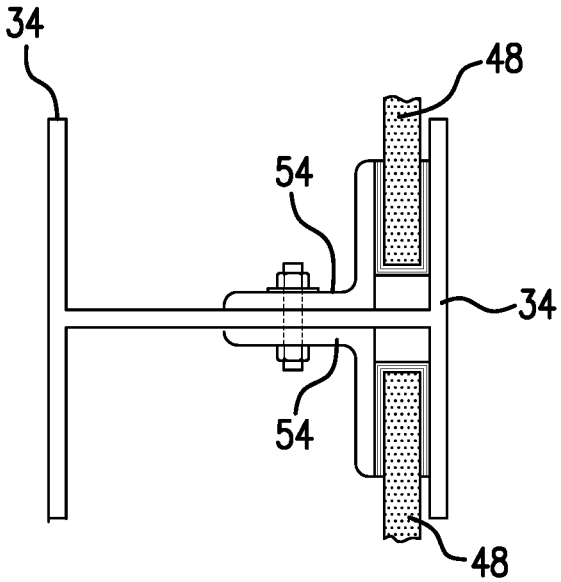
FIG. 10 is a plan view taken along line 10-10 of FIG. 2.

Each acoustical panels 48 is designed to be positioned between, and secured to, adjacent posts 34. This is accomplished by one horizontally oriented L-shaped bracket 52 and two vertically oriented L-shaped brackets 54. The vertically oriented L-shaped brackets create a U-shape for use in accepting the bottom edge of a panel 48. In particular, the horizontal L-shaped bracket 52 is attached to adjacent posts 34. FIG. 6 is a top plan view of two adjoining horizontally oriented L-shaped brackets 52. FIG. 9 illustrates the cross section of one horizontal L-shaped bracket 52 holding the bottom edge of an acoustical panel 48. An EPDM gasket (an ethylene propylene diene monomer) can be positioned between the bracket 52 and the panel 48. Other elastomers can likewise be used, both within L-shaped bracket 52 or U-shaped bracket 54. The sides of each acoustic panel 48 are retained by vertically arranged L-shaped brackets 54. As noted in FIG. 10, each of these brackets 54 is secured to the forward face of a post 34. The combination of the horizontal and vertical L-shaped brackets (52, 54) secures each acoustical panel 48 to its two adjacent posts 34. In the preferred embodiment, acoustical panels 48 are formed from a transparent acrylic material. Such a material deflects sounds and is highly transparent. It may also include embedded polyamide threads. These threads retain any sheet fragments in the event of breakage. A suitable commercially available material is Acrylite® Soundstop GS CC from Evonik Cyro LLC of Parsippany, N.J. Other acoustically isolating materials will be known to those of ordinary skill.

Each of the posts include a pair of protection holes 56 located immediately above the upper anchorage plate 36. These protection holes 56 makes the associated post 34 frangible or breakable. In the preferred embodiment, the frangible region is located just below the top edge of the associated crashworthy traffic barrier 22. This allows post 34 to shear just below the top edge of the barrier 22 so no part of the post 34 will remain above barrier 22 following an impact. This reduces any possible hazards that may impact or snag a vehicle or passenger during an accident. The depicted protection holes 56 have a half inch diameter and allow the posts 34 to breakaway or fail on impact. The frangibility can also be provided by notches in the sides of the post 34 or otherwise providing a stressed or weakened area in the post 34. For example, post 34 may include a post splice or a v-notch. Regardless of how provided, the frangible region allows the posts 34 to break, or to otherwise become dislocated from the traffic barrier 22, upon impact. As described hereinafter, the anchor cable 64 thereafter prevents the acoustic panels 48 and posts 34 from falling or otherwise damaging the vehicle or adjacent pedestrians. Each post 34 also includes holes 58 for a pair of restrainer cables 62. The restrainer cables 62 that extend from each post 34 to approximately 6 inches into the adjacent panel 48. Restrainer cables 62 help keep the posts 34 and panels 48 together.

The anchor cable 64 includes a first end that is attached to the anchor post 42, preferably at a location adjacent to the anchorage plates 36. In a preferred but non-limiting example, anchor cable 64 is ¾" diameter galvanized cable. Anchor cable 64 then extends to the top of the first post 44 and along the intermediate posts 46. To facilitate the connection between the anchor cable 64 and posts (44, 46), a guide hole 66 is provided at the top of each post. A U-shaped clevis 68 and shim plate 72 then secure anchor cable 64 in place. Thus, anchor cable 64 is anchored at the anchor post 42 and then is routed through the guide holes 66 of the adjacent posts 34. By way of the vertically and horizontally arranged L-shaped brackets (52, 54), the panels 48 are secured to the posts 34. Thus, in the event of a vehicle impact, even if one or more posts 34 becomes dislodged, the anchor cable 64 will suspend the upper ends of the posts 34 and acoustic panels 48. This prevents any damage to the vehicle or adjacent pedestrians. It further prevents intrusion into the vehicle compartment. Equally as important, by having the posts 34 break away upon impact, system 20 allows the crashworthy traffic barrier 22 to operate as intended. The design of this system 20 is in accordance with AASHTO LRFD Bridge Design Specifications, 2014 addition with 2015/2016 interims. The structural steel beams or posts are made in accordance with ASTM A709, Gr50.

It is also within the scope of the present invention to anchor the opposing ends of anchor cable 64 to the ground immediately adjacent the endmost barriers 22. It is also possible to attach the ends of anchor cable 64 to ground mounted posts, or an adjacent ground mounted noise wall or crashworthy barrier.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A traffic barrier system for absorbing vehicle impacts and reducing traffic noise, the traffic barrier system comprising:

a roadway for vehicular traffic, the roadway having opposing shoulders;

a series of traffic barriers, each barrier having opposing ends, the series of traffic barriers being arranged in an end to end fashion adjacent one of the opposing shoulders, the series of traffic barriers forming an upper edge, each traffic barrier including an enlarged base, a sloped front face, and a planar back face, the sloped front face adapted to absorb vehicle impacts and to route impacting vehicles back onto the roadway;

a series of posts, each post including upper and lower extents, an anchor plate and two anchor bolts securing the lower extent of each post to the back face of an associated traffic barrier, each of the posts including two protection holes formed adjacent the upper edge of the associated traffic barrier, the protection holes making the posts frangible upon vehicle impacts at a location adjacent the upper edge of the associated traffic barrier, each post further including a guide hole formed at the upper extent;

a series of acoustic panels, each acoustic panel being formed from a transparent acrylic material and being secured between adjacent posts by way of one or more brackets, the acoustic panels functioning to reduce traffic noise;

an anchor cable including opposing ends and an intermediate extent, each of the opposing ends being secured to one of the series of traffic barriers, the intermediate extent of the anchor cable being threaded through the guide holes of the series of posts;

whereby the intermediate extent of the anchor cable functions in suspending associated posts and acoustic panels in the event the associated posts become detached from the traffic barriers upon a vehicle impact.

2. A traffic barrier system comprising:

a roadway for vehicular traffic, the roadway including a shoulder;

a series of traffic barriers, each barrier having opposing ends, the series of traffic barriers being arranged in an end to end fashion adjacent the shoulder, the series of traffic barriers forming an upper edge;

a series of posts, each post including upper and lower extents and a frangible region, with the lower extents secured to the series of traffic barriers;

a series of acoustic panels each being secured between adjacent posts by way of one or more brackets;

an anchor cable being suspended above the series of traffic barriers and including an intermediate extent, the intermediate extent secured to each of the series of posts;

whereby the intermediate extent of the anchor cable functions in suspending a secured post in the event the secured post becomes detached from an associated traffic barrier.

3. The traffic barrier system as described in claim 2 wherein the frangible region is located adjacent the upper edge of an associated traffic barrier.

4. The traffic barrier system as described in claim 3 wherein each frangible region is formed by two protection holes within the lower extent of each post.

5. The traffic barrier system as descried in claim 2 wherein each post further including a guide hole formed at the upper extent and wherein the intermediate extent of the anchor cable is threaded through each of the guide holes.

6. The traffic barrier system as described in claim 2 wherein the anchor cable includes first and second ends and wherein the first end is secured to a first traffic barrier of the series of traffic barriers and the second end is secured to a last traffic barrier of the series of traffic barriers.

7. The traffic barrier system as described in claim 2 further comprising a series of anchor plates and anchor bolts for securing the lower extent of each post to the back face of an associated traffic barrier.

8. The traffic barrier system as described in claim 2 wherein each traffic barrier includes an enlarged base, a sloped front face, and a planar back face, the sloped front face adapted to absorb vehicle impacts and to route impacting vehicles back onto the roadway.

9. The traffic barrier system as described in claim 2 wherein each panel is formed from a transparent acrylic material.

10. The traffic barrier as described in claim 1 wherein the anchor cable is suspended above the series of traffic barriers.

* * * * *